US007986202B2

(12) United States Patent
Woodson et al.

(10) Patent No.: US 7,986,202 B2
(45) Date of Patent: Jul. 26, 2011

(54) CIRCUIT BREAKER CURRENT TRANSFORMER CONDUCTOR LOCATION DEVICE FOR IMPROVED SENSING ACCURACY AND ASSEMBLY

(76) Inventors: Cameron L. Woodson, Cedar Rapids, IA (US); Chad R. Mittelstadt, Cedar Rapids, IA (US)

( * ) Notice: Subject to any disclaimer, the term of this patent is extended or adjusted under 35 U.S.C. 154(b) by 426 days.

(21) Appl. No.: 12/337,932

(22) Filed: Dec. 18, 2008

(65) Prior Publication Data

US 2010/0155136 A1 Jun. 24, 2010

(51) Int. Cl.
*H01H 75/00* (2006.01)
*H01F 17/06* (2006.01)
*H01F 27/30* (2006.01)

(52) U.S. Cl. ..... 335/6; 335/18; 336/175; 336/196; 336/197

(58) Field of Classification Search ..... 335/6, 18; 336/173–176, 196, 197; 361/42
See application file for complete search history.

(56) References Cited

U.S. PATENT DOCUMENTS 4,408,175 A * 10/1983 Nelson et al. ..... 336/92
4,907,342 A 3/1990 Castonguay et al. ..... 29/622
5,327,112 A 7/1994 Rossetti ..... 335/78
5,889,450 A 3/1999 Kim et al. ..... 355/18
6,414,579 B1 * 7/2002 Tiemann et al. ..... 336/173
6,639,770 B2 10/2003 Tiemann et al. ..... 361/45
7,859,378 B2 * 12/2010 Merck et al. ..... 336/90
2006/0006976 A1 * 1/2006 Bruno ..... 336/229
2010/0148907 A1 * 6/2010 Younsi et al. ..... 336/180

OTHER PUBLICATIONS

Square-D; "*Instruction Bulletin: One-Pole QO® and QOB Equipment Protective Device (EPD) (30 mA Ground-Fault Trip Level )*"; Sep. 2003 (4 pages).
Square-D; "*Instruction Bulletin: HOM One-Pole Equipment Protection Device (EPD)*"; Nov. 2003 (4 pages).
Square-D; "*Instruction Bulletin: HOM Two-Pole Equipment Protection Device (EPD)*"; Nov. 2003 (6 pages).
Square-D; "*Instruction Bulletin: Two-Pole QO®/QOB Circuit Breaker and Equipment Protective Device (EPD) (30 mA Ground-Fault Trip Level)*"; Apr. 2008 (4 pages).
Square-D; "*Instruction Bulletin: GFM150HD and GFM250JD Ground-Fault Modules With Micrologic® Trip Level*"; Jul. 2008 (20 pages).

* cited by examiner

*Primary Examiner* — Ramon M Barrera

(57) ABSTRACT

A circuit breaker includes a breaker housing, a transformer housing, and a plurality of conductor locators. The transformer housing is enclosed within the breaker housing and has an opening for receiving a plurality of conductors. The plurality of conductor locators is desirably located adjacent to the transformer housing and is movable between an open position and a closed position. The conductors are generally centered in the opening of the transformer housing when the conductor locators are in the closed position.

20 Claims, 5 Drawing Sheets

CIRCUIT BREAKER CURRENT TRANSFORMER CONDUCTOR LOCATION DEVICE FOR IMPROVED SENSING ACCURACY AND ASSEMBLY

FIELD OF THE INVENTION

This invention is directed generally to a transformer for a circuit breaker, and, more particularly, to a current transformer housing for routing conductors in a controlled manner.

BACKGROUND OF THE INVENTION

Electrical current transformers are generally an integral part of some circuit breakers. For example, one type of transformers is included in ground fault circuit breakers, which are commonly used to protect people from electrical shocks due to line-to-ground current flow through a person's body. Ground fault circuit breakers are required to detect current flow between line conductors and ground at current levels on the order of about 5 milliamperes. These low current levels are much below the overload current levels required to trip conventional circuit breakers. In response to detecting of a ground fault current, the circuit breaker is tripped to prevent further flow of current through the protected circuit. Specifically, a movable contact of the circuit breaker is separated from a fixed contact to prevent further current flow.

The primary windings for this type of transformer are the conductors of the distribution circuit being protected. Specifically, the conductors are encircled in a transformer housing core. For example, in a two-pole circuit breaker three conductors are routed through an opening in the transformer housing: two line conductors (i.e., line one and line two) and the neutral conductor. In a three-pole circuit breaker four conductors are routed through the opening: three line conductors and the neutral conductor.

During normal conditions, current flowing in one direction through a line conductor will return in the opposite direction through the neutral conductor. This produces a net current flow of zero through the transformer and, accordingly, a multi-turn winding provides no output. If, however, a fault is established between one of the line conductors and the ground, more current will flow in one direction through the transformer than in the other direction, producing a current imbalance. The current imbalance produces uncancelled flux in the transformer's core, resulting in an output in the multi-turn winding that trips the circuit breaker mechanism.

One problem associated with some transformers is that conductors and/or terminal assemblies cannot be properly routed through the transformer housing. For example, in some transformers the routing of a conductor may be possible only before any terminals or lugs are welded to the conductor. Such assembly restrictions result in difficult and rigid assembly methods, which are likely to increase manufacturing time and cost.

Another problem associated with some transformers, is that the physical position of the conductors and/or terminal assemblies cannot be accurately controlled within the space of the transformer through which they are being routed to achieve a required level of milliamperes sensing. Accordingly, the functionality and/or reliability of the transformer can be greatly reduced.

What is needed, therefore, is a transformer housing for a circuit breaker that addresses the above-stated and other problems.

SUMMARY OF THE INVENTION

In an implementation of the present invention, a circuit breaker includes a breaker housing, a transformer housing, and a plurality of conductor locators. The transformer housing is enclosed within the breaker housing and has an opening for receiving a plurality of conductors. The plurality of conductor locators is located adjacent to the transformer housing and is movable between an open position and a closed position. The plurality of conductors is generally centered in the opening of the transformer housing when the conductor locators are in the closed position.

In an alternative implementation of the present invention, a ground fault multi-pole circuit breaker assembly includes a circuit breaker housing for enclosing a multi-pole circuit breaker assembly, and a transformer housing mounted inside the circuit breaker housing. The transformer housing has an internal opening for receiving a plurality of conductors. Each of the conductors has an end fastening component, the end fastening component being attached to the respective one of the conductors prior to the respective one of the conductors being received within the internal opening. A pair of conductor locators is mounted to the transformer housing, each of the pair of conductor locators having a fixed end and movable end. The movable end of the conductors is movable between an open position and a closed position. The conductors are forced in close proximity to each other in a generally centered position of the internal opening when the pair of conductor locators are moved to the closed position, thus providing an improved sensing capability in the milliamp range.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
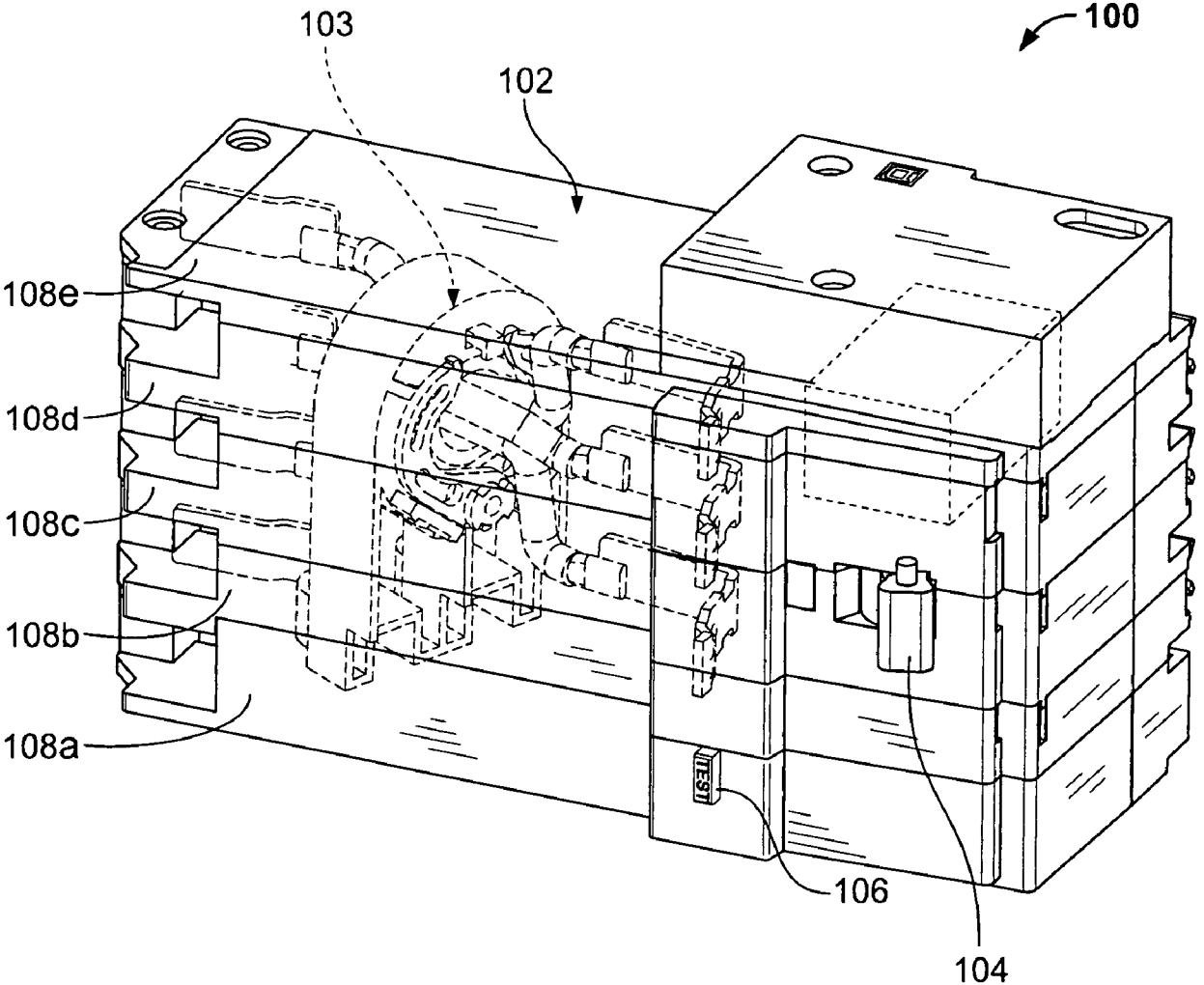
FIG. 1 is a perspective of a multi-pole circuit breaker including a transformer assembly, according to one embodiment.

Referring to FIG. 1, a three pole circuit breaker 100 includes a circuit breaker housing 102 for enclosing internal components of the circuit breaker 100, including a transformer assembly 103 (which is described in more detail below). A handle 104 protrudes through the circuit breaker housing 102 for manually resetting the circuit breaker 100. The handle 104 can also serve as a visual indication of the status of the circuit breaker 100 (e.g., when the circuit breaker 100 is in a tripped position).

A test button 106 also protrudes through the circuit breaker housing 102. The test button 106 can be pressed to perform, for example, self-diagnostics tests related to a microprocessor of the circuit breaker 100.

The circuit breaker housing 102 can include several housing elements. For example, the circuit breaker housing 102 can include a housing base 108*a*, a housing enclosure 108*b*-108*d* for each of the three poles of the circuit breaker 100, and a housing cover 108*e*. In alternative embodiments, any number of housing elements can be used to form the circuit breaker housing 102.

Figure 2:
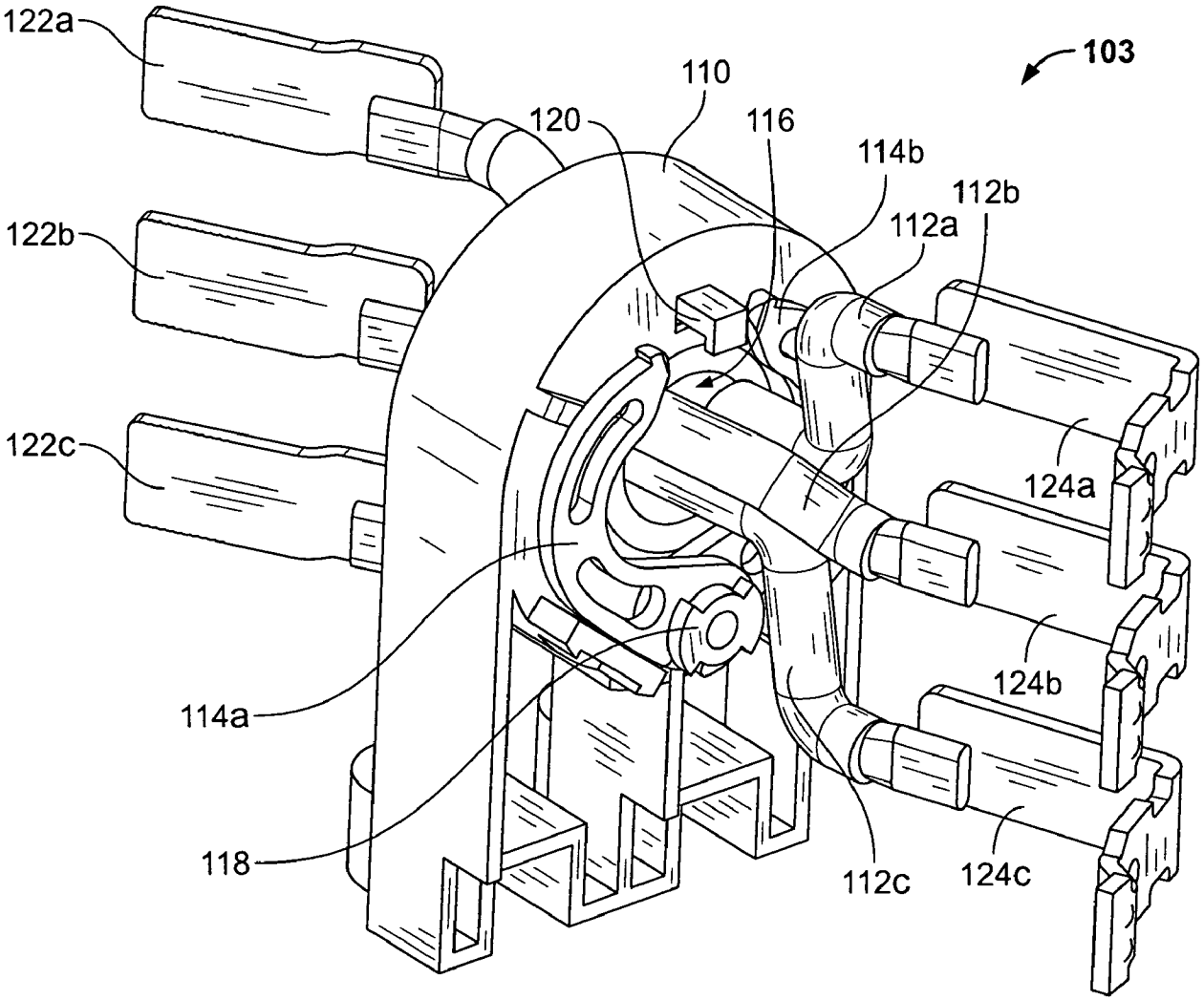
FIG. 2 is a perspective view of the transformer assembly.

Referring to FIG. 2, the transformer assembly 103 includes a transformer housing 110 through which a plurality of conductor wires 112*a*-112*c* are inserted. Two conductor locators (a left conductor locator 114*a* and a right conductor locator 114*b*) are mounted to the transformer housing 110 near an oversized internal opening 116. The conductor locators 114*a*, 114*b* are fixed at their respective lower ends via a fastener element 118, and are pivotable at their respective upper ends.

The conductor locators 114*a*, 114*b* are pivotable between an open position (as illustrated in FIG. 2) and a closed position. The transformer housing 110 further includes a locking element 120 near the upper ends of the conductor locators 114*a*, 114*b*. The locking element 120 secures the conductor locators 114*a*, 114*b* when they are in the closed position.

The conductor wires 112*a*-112*c* include respective power terminals 122*a*-122*c*, which are welded on one end of the conductor wires 112*a*-112*c* prior to insertion of the conductor wires 112*a*-112*c* through the opening 116. The conductor wires 112*a*-112*c* further include respective power contacts 124*a*-124*c*, which are welded on another end of the conductor wires 112*a*-112*c* prior to insertion of the conductor wires 112*a*-112*c* through the opening 116.

Figure 3A:
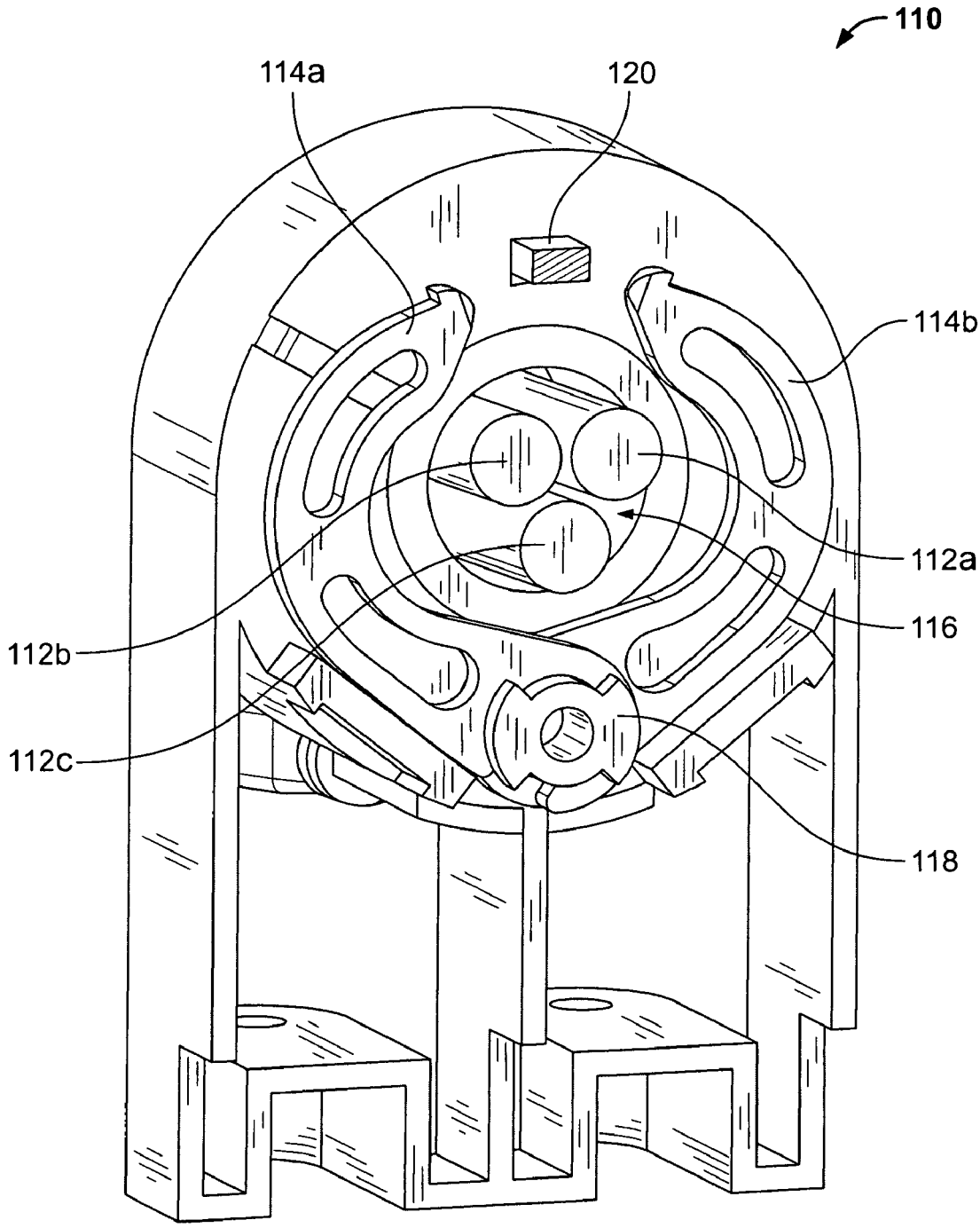
FIG. 3A is a perspective view of the transformer assembly illustrating a plurality of locating cams in an open position.

Referring to FIG. 3A, the conductor locators 114*a*, 114*b* are more clearly illustrated in the open position. According to the illustrated embodiment, the conductor locators 114*a*, 114*b* are two cams that are generally opposable mirror images of each other Furthermore, each of the two cams has an outer arcuate shape and an inner arcuate shape. In the closed position, the inner arcuate shape of each cam forms half of a generally circular hole.

In the open position, the conductor locators 114*a*, 114*b* are positioned outwards, away from the opening 116, such that they do not obstruct the opening 116. The conductor wires 112*a*-112*c* are easily inserted through the opening 116 when the conductor locators 114*a*, 114*b* are in the open position. The illustrated opening 116 is large enough to permit insertion of the conductor wires 112*a*-112*c* and the power terminals 122*a*-122*c* or the power contacts 124*a*-124*c*. In other words, the opening 116 can be referred to as an "oversized" opening that is dimensioned such that a gap can be present between the conductor wires 112*a*-112*c* and the diameter of the opening 116 after the conductor wires 112*a*-112*c* have been inserted through the opening 116.

Figure 3B:
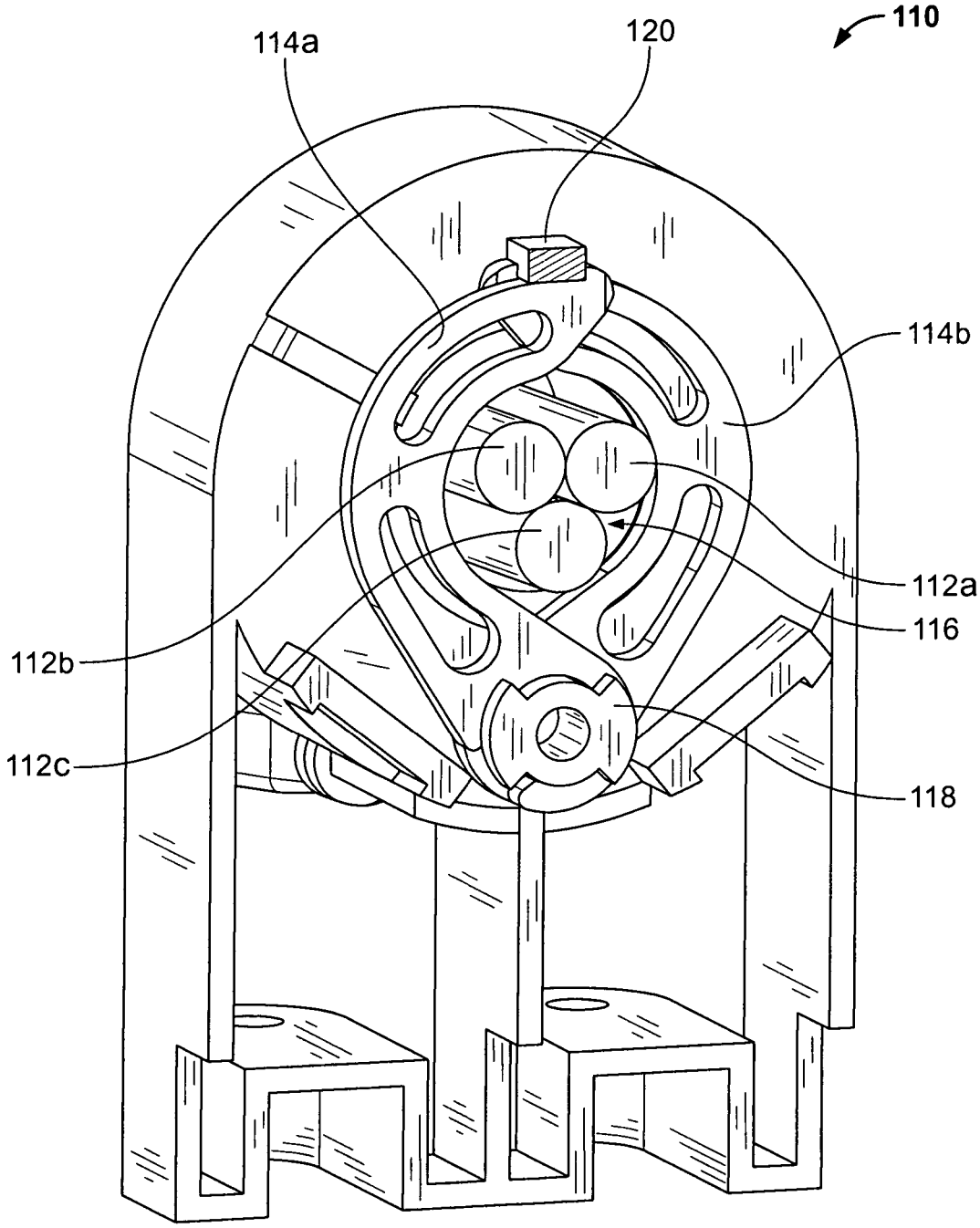
FIG. 3B is a perspective view of the transformer assembly illustrating the locating cams in a closed position.

Referring to FIG. 3B, the conductor locators 114*a*, 114*b* are now illustrated in the closed position. The left conductor locator 114*a* has been pivoted in a clockwise direction to place it in the closed position. The left conductor locator 114*a* is now secured in the closed position via the locking element 120. For example, to secure the left conductor locator 114*a* in the closed position the upper end of the left conductor locator 114*a* is snapped past the locking element 120.

The right conductor locator 114*b* has been pivoted in a counter-clockwise direction to place it in the closed position. Similar to the left conductor locator 114*a*, the right conductor locator 114*b* is also secured in the closed position via the locking element 120.

In the closed position, the conductor wires 112*a*-112*c* have been moved in close proximity to one another. In fact, the conductor wires 112*a*-112*c* are now in contact with each other and are centrally positioned in the opening 116.

The centering mechanism of the conductor locators 114*a*, 114*b* provides increased flexibility during manufacturing and assembly of the circuit breaker 100. The opening 116 is large enough to permit the insertion of the conductor wires 112*a*-112*c* together with the power terminals 122*a*-122*c* or the power contacts 124*a*-124*c*. However, because of the relatively large size of the opening 116, the conductor wires 112*a*-112*c* are now most likely to remain in positions too far away from each other to properly sense changes in current, e.g., a five milliamp change in current between a power conductor and a neutral conductor. The centering mechanism of the conductor locators 114*a*, 114*b* provides a solution to the positioning problem. After insertion of the conductor wires 112*a*-112*c*, the conductor locators 114*a*, 114*b* are instrumental in positioning the conductor wires 112*a*-112*c* close enough to each other such that the required current change can be adequately sensed.

Figure 4A:
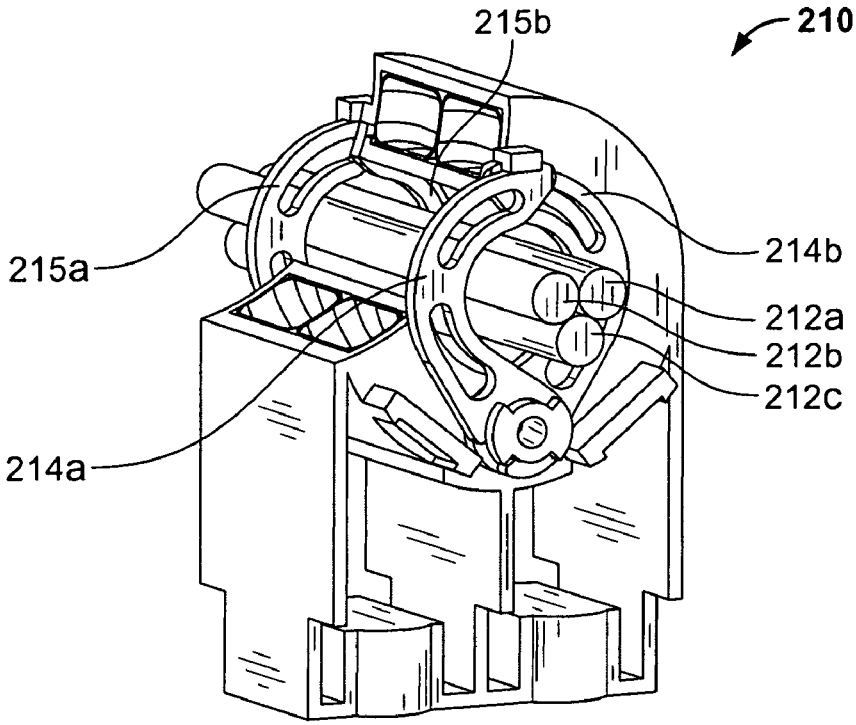
FIG. 4A is a partial cut-away perspective view of a transformer assembly having two pairs of locating cams, according to another embodiment.

Referring to FIG. 4A, a transformer housing 210 includes a centering mechanism in accordance with an alternative embodiment. Specifically, the transformer housing 210 includes two pairs of conductor locators, a first pair of conductor locators 214*a*, 214*b* and a second pair of conductor locators 215*a*, 215*b*. The first pair of conductor locators 214*a*, 214*b* is mounted on a first side of the transformer housing 210, and the second pair of conductor locators 215*a*, 215*b* is mounted on a second side (which is opposite the first side) of the transformer housing 210.

Providing two pairs of conductor locators, instead of a single pair, is likely to increase the distance over which conductor wires 212*a*-212*c* are in close proximity with each other and centered in the transformer housing 210. For example, if a single pair of conductor locators is used, the conductor wires 212*a*-212*c* may likely only be in close proximity with each other near the single pair of conductor locators. Having two pairs of conductor locators increases the likelihood that the conductor wires 212*a*-212*c* are in close proximity with each other for at least the entire distance separating the two pairs of conductor locators 214*a*, 214*b* and 215*a*, 215*b*. Thus, based on the increased distance over which the conductor wires 212*a*-212*c* are properly positioned, the sensing performance of the transformer is likely to increase.

Figure 4B:
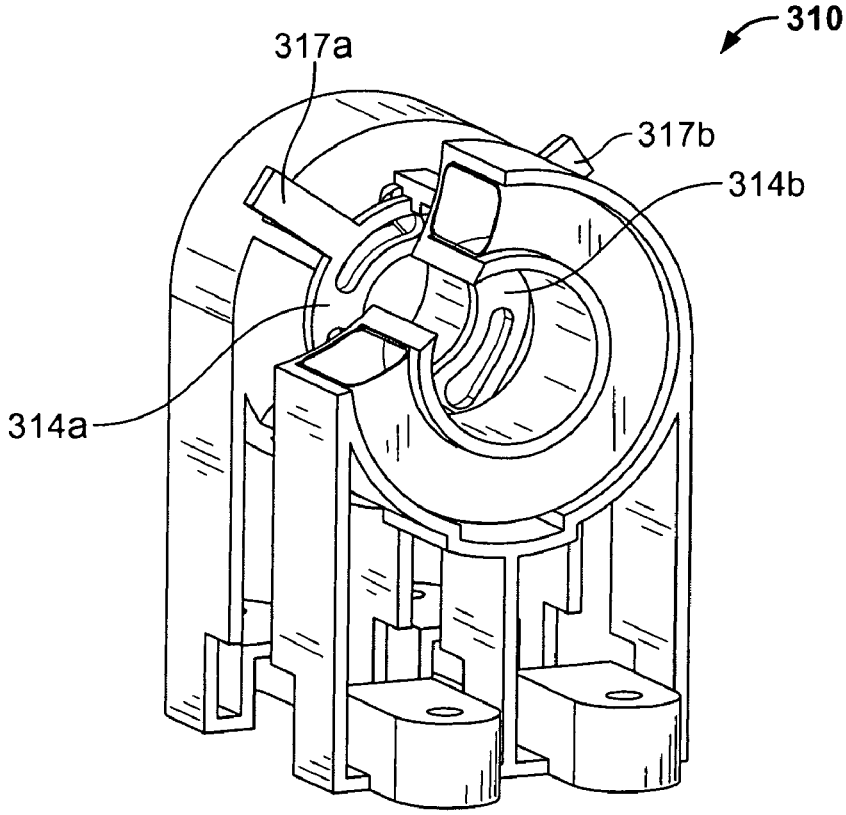
FIG. 4B is a partial cut-away perspective view of a transformer assembly having a single centrally located pair of locating cams, according to yet another embodiment.

Referring to FIG. 4B, a transformer housing 310 includes a centering mechanism in accordance with another alternative embodiment. Specifically, the transformer housing 310 includes a single pair of conductor locators 314*a*, 314*b*, which is generally centrally located within the transformer housing 310. Placement of the conductor locators 314*a*, 314*b* in a central location is likely to increase the likelihood that any conductor wires will remain in close proximity to each other for a longer distance as the conductor wires extend away from the conductor locators 314*a*, 314*b*.

The conductor locators 314*a*, 314*b* include, respectively, a locator tab 317*a*, 317*b*. The locator tabs 317*a*, 317*b* can be grasped by an operator to pivot the conductor locators 314*a*, 314*b* between the open and closed positions.

According to other alternative embodiments, the conductor locators can move in any manner between the open position and the closed position. For example, the conductor locators can slide (instead of pivoting) between the open position and the closed position.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A circuit breaker comprising:

a breaker housing;

a transformer housing enclosed within the breaker housing and having an opening for receiving a plurality of conductors; and a plurality of conductor locators located adjacent to the transformer housing and being movable between an open position and a closed position, the plurality of conductors being generally centered in the opening of the transformer housing when the conductor locators are in the closed position.

2. The circuit breaker of claim 1, wherein the conductor locators are coupled to the transformer housing.

3. The circuit breaker of claim 1, wherein the conductor locators are two cams.

4. The circuit breaker of claim 3, wherein the two cams are opposable mirror images of each other.

5. The circuit breaker of claim 3, wherein each of the two cams has an inner arcuate shape, the inner arcuate shape forming half of a generally circular hole.

6. The circuit breaker of claim 1, wherein the conductor locators are pivotable between the open position and the closed position.

7. The circuit breaker of claim 1, wherein each of the conductor locators has a fixed end and an open end, the open end of the conductor locators being snapped in place in the closed position to a common locking element.

8. The circuit breaker of claim 1, wherein the common locking element is formed in or on the transformer housing.

9. The circuit breaker of claim 1, wherein the conductor locators include a first pair of conductor locators and a second pair of conductor locators, the first pair of conductor locators being mounted on a first side of the transformer housing, the second pair of conductor locators being mounted on a second side of the transformer.

10. The circuit breaker of claim 1, wherein the conductor locators include a single pair of conductor locators mounted within the transformer housing in a generally central position between a first side of the transformer housing and a second side of the transformer housing, the plurality of conductors being received within the opening by entering near one of the first side and the second side and exiting near the other one of the first side and the second side.

11. The circuit breaker of claim 1, wherein at least one of the single pair of conductor locators includes a locator tab for moving the respective conductor locator between the open position and the closed position.

12. The circuit breaker of claim 1, wherein at least one of the plurality of conductors includes a fastening component, the fastening component being attached to the respective conductor prior to insertion of the respective conductor in the opening of the transformer housing.

13. The circuit breaker of claim 1, wherein the plurality of conductors includes three conductors selected from power and ground conductors.

14. The circuit breaker of claim 3, wherein the circuit breaker includes a five milliamp ground fault sensing capability.

15. A ground fault multi-pole circuit breaker assembly comprising:

a circuit breaker housing for enclosing a multi-pole circuit breaker assembly;

a transformer housing mounted inside the circuit breaker housing, the transformer housing having an internal opening;

a plurality of conductors received within the internal opening, each of the conductors having an end fastening component, the end fastening component being attached to the respective one of the conductors prior to the respective one of the conductors being received within the internal opening; and a pair of conductor locators mounted to the transformer housing, each of the pair of conductor locators having a fixed end and movable end, the movable end being movable between an open position and a closed position, the conductors being forced in close proximity to each other in a generally centered position of the internal opening when the pair of conductor locators are moved to the closed position.

16. The ground fault multi-pole circuit breaker assembly of claim 15, wherein the pair of conductor locators are two pivotable cams.

17. The ground fault multi-pole circuit breaker assembly of claim 15, further comprising a locking member for receiving the movable end of each of the pair of conductor locators in the closed position, the locking member securing in the closed position the pair of conductor locators.

18. The ground fault multi-pole circuit breaker assembly of claim 15, wherein the pair of conductor locators is mounted on a side of the transformer housing.

19. The ground fault multi-pole circuit breaker assembly of claim 18, further comprising another pair of conductor locators mounted to another side of the transformer housing, the another side of the transformer housing being located opposite the side of the transformer housing on which the pair of conductor locators is mounted.

20. The ground fault multi-pole circuit breaker assembly of claim 15, wherein the pair of conductor locators is mounted within the transformer housing, in a generally central location along a width of the transformer housing.

* * * * *